US007841825B2

(12) United States Patent
Chen et al.

(10) Patent No.: US 7,841,825 B2
(45) Date of Patent: Nov. 30, 2010

(54) METHOD FOR PREDICTING SURGE IN COMPRESSOR

(75) Inventors: Chun-Han Chen, Hsinchu Hsien (TW); Chung-Ping Chiang, Hsinchu (TW); Jiing-Fu Chen, Hsinchu (TW); Chung-Che Liu, Hsinchu (TW); Yun-Jui Chung, Hsinchu (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 925 days.

(21) Appl. No.: 11/711,007

(22) Filed: Feb. 27, 2007

(65) Prior Publication Data

US 2008/0101914 A1 May 1, 2008

(30) Foreign Application Priority Data

Oct. 26, 2006 (TW) ..... 95139486 A

(51) Int. Cl.
*F04D 27/02* (2006.01)

(52) U.S. Cl. ..... 415/1; 415/118

(58) Field of Classification Search ..... 415/1, 415/118

See application file for complete search history.

(56) References Cited

U.S. PATENT DOCUMENTS 4,749,331 A * 6/1988 Blotenberg ..... 415/47
6,406,268 B1 * 6/2002 Paice ..... 417/53
6,981,838 B2 * 1/2006 McKee et al. ..... 415/1

* cited by examiner

*Primary Examiner*—Edward Look
*Assistant Examiner*—Dwayne J White
(74) *Attorney, Agent, or Firm*—Birch, Stewart, Kolasch & Birch, LLP

(57) ABSTRACT

A method for predicting surge in a compressor is provided, which is applicable to a cooling apparatus equipped with a centrifugal compressor. A set of highest outlet pressure values is obtained by a performance test performed on the centrifugal compressor. A coolant flow rate value and an opening percentage value of inlet guide vanes of the centrifugal compressor are measured. An outlet pressure value of the centrifugal compressor is calculated with an equation using the measured coolant flow rate value and the measured opening percentage value. The outlet pressure value is compared with one of the highest outlet pressure values corresponding to the measured opening percentage value, and if the outlet pressure value is larger than or equal to the highest corresponding outlet pressure value, it confirms imminent surge in the centrifugal compressor, so as to provide a basis of preparation for surge elimination.

6 Claims, 11 Drawing Sheets

| coolant flow rate (kg/s) | outlet pressure value(kgf/m$^2$) | opening percentage of inlet guide vanes |
|---|---|---|
| 4.7 | 77630 | 0.3 |
| 5.17 | 77640 | 0.3 |
| 5.64 | 77560 | 0.3 |
| 6.11 | 77390 | 0.3 |
| 6.58 | 77110 | 0.3 |
| 7.05 | 76700 | 0.3 |
| 7.52 | 76190 | 0.3 |
| 7.99 | 75590 | 0.3 |
| 8.46 | 74880 | 0.3 |
| 8.93 | 74050 | 0.3 |
| 9.4 | 73100 | 0.3 |
| 9.87 | 71980 | 0.3 |
| 10.34 | 70390 | 0.3 |
| 10.81 | 67810 | 0.3 |
| 11.28 | 64090 | 0.3 |
| 11.703 | 60040 | 0.3 |

FIG. 2B

| coolant flow rate (kg/s) | outlet pressure value(kgf/m$^2$) | opening percentage of inlet guide vanes |
|---|---|---|
| 5.5 | 90820 | 0.4 |
| 6 | 90840 | 0.4 |
| 6.5 | 90770 | 0.4 |
| 7 | 90600 | 0.4 |
| 7.5 | 90340 | 0.4 |
| 8 | 89940 | 0.4 |
| 8.5 | 89450 | 0.4 |
| 9 | 88870 | 0.4 |
| 9.5 | 88180 | 0.4 |
| 10 | 87400 | 0.4 |
| 10.5 | 86490 | 0.4 |
| 11 | 85470 | 0.4 |
| 11.5 | 84290 | 0.4 |
| 12 | 82690 | 0.4 |
| 12.5 | 80210 | 0.4 |
| 13 | 76620 | 0.4 |
| 13.5 | 72030 | 0.4 |

FIG. 2C

| coolant flow rate (kg/s) | outlet pressure value(kgf/m$^2$) | opening percentage of inlet guide vanes |
|---|---|---|
| 5.836 | 95910 | 0.5 |
| 6.367 | 95920 | 0.5 |
| 6.897 | 95830 | 0.5 |
| 7.428 | 95650 | 0.5 |
| 7.958 | 95370 | 0.5 |
| 8.489 | 94930 | 0.5 |
| 9.019 | 94400 | 0.5 |
| 9.55 | 93770 | 0.5 |
| 10.081 | 93040 | 0.5 |
| 10.611 | 92190 | 0.5 |
| 11.142 | 91220 | 0.5 |
| 11.672 | 90110 | 0.5 |
| 12.203 | 88830 | 0.5 |
| 12.733 | 87050 | 0.5 |
| 13.264 | 84280 | 0.5 |
| 13.794 | 80300 | 0.5 |
| 14.325 | 75340 | 0.5 |

FIG. 2D

| coolant flow rate (kg/s) | outlet pressure value(kgf/$m^2$) | opening percentage of inlet guide vanes |
|---|---|---|
| 6.166 | 98660 | 0.6 |
| 6.727 | 98640 | 0.6 |
| 7.287 | 98510 | 0.6 |
| 7.848 | 98280 | 0.6 |
| 8.408 | 97920 | 0.6 |
| 8.969 | 97420 | 0.6 |
| 9.529 | 96810 | 0.6 |
| 10.09 | 96090 | 0.6 |
| 10.651 | 95250 | 0.6 |
| 11.211 | 94280 | 0.6 |
| 11.772 | 93190 | 0.6 |
| 12.332 | 91920 | 0.6 |
| 12.893 | 90310 | 0.6 |
| 13.453 | 87810 | 0.6 |
| 14.014 | 84090 | 0.6 |
| 14.574 | 79040 | 0.6 |
| 14.855 | 76280 | 0.6 |

FIG. 2E

| coolant flow rate (kg/s) | outlet pressure value(kgf/$m^2$) | opening percentage of inlet guide vanes |
|---|---|---|
| 5.906 | 100300 | 0.7 |
| 6.496 | 100300 | 0.7 |
| 7.087 | 100300 | 0.7 |
| 7.677 | 100100 | 0.7 |
| 8.268 | 99820 | 0.7 |
| 8.858 | 99360 | 0.7 |
| 9.449 | 98770 | 0.7 |
| 10.039 | 98060 | 0.7 |
| 10.63 | 97220 | 0.7 |
| 11.221 | 96250 | 0.7 |
| 11.811 | 95160 | 0.7 |
| 12.402 | 93850 | 0.7 |
| 12.992 | 92290 | 0.7 |
| 13.583 | 89880 | 0.7 |
| 14.173 | 86150 | 0.7 |
| 14.764 | 81010 | 0.7 |
| 15.118 | 77540 | 0.7 |

FIG. 2F

| coolant flow rate (kg/s) | outlet pressure value(kgf/m$^2$) | opening percentage of inlet guide vanes |
|---|---|---|
| 6.019 | 101200 | 0.8 |
| 6.454 | 101200 | 0.8 |
| 6.888 | 101200 | 0.8 |
| 7.323 | 101100 | 0.8 |
| 7.757 | 100900 | 0.8 |
| 8.191 | 100700 | 0.8 |
| 8.626 | 100400 | 0.8 |
| 9.06 | 100100 | 0.8 |
| 9.495 | 99670 | 0.8 |
| 9.929 | 99170 | 0.8 |
| 10.363 | 98600 | 0.8 |
| 10.798 | 97960 | 0.8 |
| 11.232 | 97240 | 0.8 |
| 11.666 | 96450 | 0.8 |
| 12.101 | 95590 | 0.8 |
| 12.535 | 94620 | 0.8 |
| 12.97 | 93510 | 0.8 |
| 13.404 | 92020 | 0.8 |

FIG. 2G

| coolant flow rate (kg/s) | outlet pressure value(kgf/m$^2$) | opening percentage of inlet guide vanes |
|---|---|---|
| 6.316 | 101900 | 0.9 |
| 6.772 | 101900 | 0.9 |
| 7.227 | 101800 | 0.9 |
| 7.683 | 101700 | 0.9 |
| 8.139 | 101500 | 0.9 |
| 8.595 | 101200 | 0.9 |
| 9.05 | 100800 | 0.9 |
| 9.506 | 100400 | 0.9 |
| 9.962 | 99880 | 0.9 |
| 10.418 | 99280 | 0.9 |
| 10.874 | 98610 | 0.9 |
| 11.329 | 97860 | 0.9 |
| 11.785 | 97030 | 0.9 |
| 12.241 | 96110 | 0.9 |
| 12.697 | 95080 | 0.9 |
| 13.152 | 93860 | 0.9 |
| 13.608 | 92170 | 0.9 |
| 14.064 | 89750 | 0.9 |

FIG. 2H

| coolant flow rate (kg/s) | outlet pressure value(kgf/m$^2$) | opening percentage of inlet guide vanes |
|---|---|---|
| 6.215 | 101900 | 1 |
| 6.698 | 101900 | 1 |
| 7.182 | 101800 | 1 |
| 7.665 | 101700 | 1 |
| 8.149 | 101500 | 1 |
| 8.632 | 101200 | 1 |
| 9.115 | 100800 | 1 |
| 9.599 | 100300 | 1 |
| 10.082 | 99750 | 1 |
| 10.566 | 99100 | 1 |
| 11.049 | 98360 | 1 |
| 11.532 | 97530 | 1 |
| 12.016 | 96630 | 1 |
| 12.499 | 95560 | 1 |
| 12.982 | 94380 | 1 |
| 13.466 | 92790 | 1 |
| 13.949 | 90470 | 1 |
| 14.433 | 87250 | 1 |
| 14.916 | 83040 | 1 |

FIG. 2I

METHOD FOR PREDICTING SURGE IN COMPRESSOR

FIELD OF THE INVENTION

The present invention relates to methods for predicting surge in compressors, and more particularly, to a method applicable to a cooling apparatus equipped with a centrifugal compressor for predicting surge in the centrifugal compressor.

BACKGROUND OF THE INVENTION

For a central air conditioning system, a chiller is typically used as a cooling apparatus. Cold water is produced by the chiller and conveyed through pipes to decrease room temperature by heat exchange. The chiller has become widely used in recent years, and a compressor is a core operating component of the chiller. For example of a centrifugal compressor, surge usually occurs in the centrifugal compressor during operation, which not only generates noise but also aggravates the stress exerted on the driving motor and the vane bearing of the centrifugal compressor, thereby leading to damage to the centrifugal compressor. The longer the surge lasts, the more damage is dealt to the centrifugal compressor.

A surge detection method is employed currently to eliminate surge in the centrifugal compressor, which involves measurement of a single variable (such as current, temperature, or pressure) and signal processing of the measured variable to determine the occurrence of surge. U.S. Pat. No. 5,746,062 discloses such method, which analyzes a single variable and uses a threshold value as a basis of determination. As shown in FIGS. 4(*a*) and 4(*b*) of this patent, to acquire accurate and stable values for determination, after the difference in pressure is obtained by a sensor followed by a series of complicated logical determination processes are performed in order to avoid false judgment. Whether surge occurs or not can be confirmed in the centrifugal compressor by the result. The above surge detection method, however, is very complex and is time and cost-ineffective. Furthermore, the above method detect surging when it has occurred in the centrifugal compressor, and such time delay of surge determination could be accompanied with damage to the centrifugal compressor.

Therefore, the problem to be solved here is to develop a method for predicting surge in a compressor, which can overcome the aforesaid drawbacks of the prior art.

SUMMARY OF THE INVENTION

In view of the aforesaid drawbacks of the prior art, a primary objective of the present invention is to provide a method for predicting surge in a compressor, which is a simple method to predict imminent surge in a centrifugal compressor and provide a basis of preparation for surge elimination.

In order to achieve the above and other objectives, the present invention proposes a method for predicting surge in a compressor that is applicable to a cooling apparatus equipped with a centrifugal compressor. The method comprises the steps of:

(1) obtaining a set of highest outlet pressure values ($P_{compoutH}$) by a performance test performed on the centrifugal compressor;

(2) measuring a value of coolant flow rate and a value of opening percentage of inlet guide vanes (IGV) of the centrifugal compressor;

(3) calculating an outlet pressure value ($P_{compout}$) of the centrifugal compressor with Equation (1) using the measured value of coolant flow rate and the measured value of the opening percentage of the inlet guide vanes, $$Z=(P_1X+P_2Y+P_3)^3 \quad \text{Equation (1)}$$

wherein X, Y and Z represent the value of opening percentage of the inlet guide vanes, the value of coolant flow rate, and the outlet pressure value, respectively, and $P_1$, $P_2$ and $P_3$ are known values; and (4) determining if the outlet pressure value is larger than or equal to one of the highest outlet pressure values corresponding to the value of opening percentage of the inlet guide vanes measured in step (2), and if yes, confirming that surge is going to occur in the centrifugal compressor so as to provide a basis of preparation for surge elimination.

Unlike the prior art, the method for predicting surge in a compressor according to the present invention can predetermine whether surge is going to occur in the compressor. The method involves measuring a value of opening percentage of inlet guide vanes and a value of coolant flow rate of a centrifugal compressor, calculating an outlet pressure value of the centrifugal compressor with the above Equation (1), comparing the outlet pressure value with a highest outlet pressure value (obtained by a performance test performed on the centrifugal compressor) corresponding to the measured value of opening percentage of the inlet guide vanes, and confirming the occurrence of imminent surge in the centrifugal compressor if it determines that the outlet pressure value is larger than or equal to the highest corresponding outlet pressure value. Thus, this provides a basis of preparation for surge elimination.

BRIEF DESCRIPTION OF THE DRAWINGS

The patent or application file contains at least one drawing executed in color. Copies of this patent or patent application publication with color drawing(s) will be provided by the office upon request and payment of the necessary fee.

The present invention can be more fully understood by reading the following detailed description of the preferred embodiments, with reference made to the accompanying drawings, wherein:

FIGS. 2B to 2I are tables showing coolant flow rate values and outlet pressure values for respective inlet guide vane opening percentages in FIG. 2A.

DETAILED DESCRIPTION OF THE PREFERRED EMBODIMENT

The preferred embodiment of a method for predicting surge in a compressor as proposed in the present invention is described as follows with reference to FIGS. 1, 2A to 2I and 3.

Figure 1:
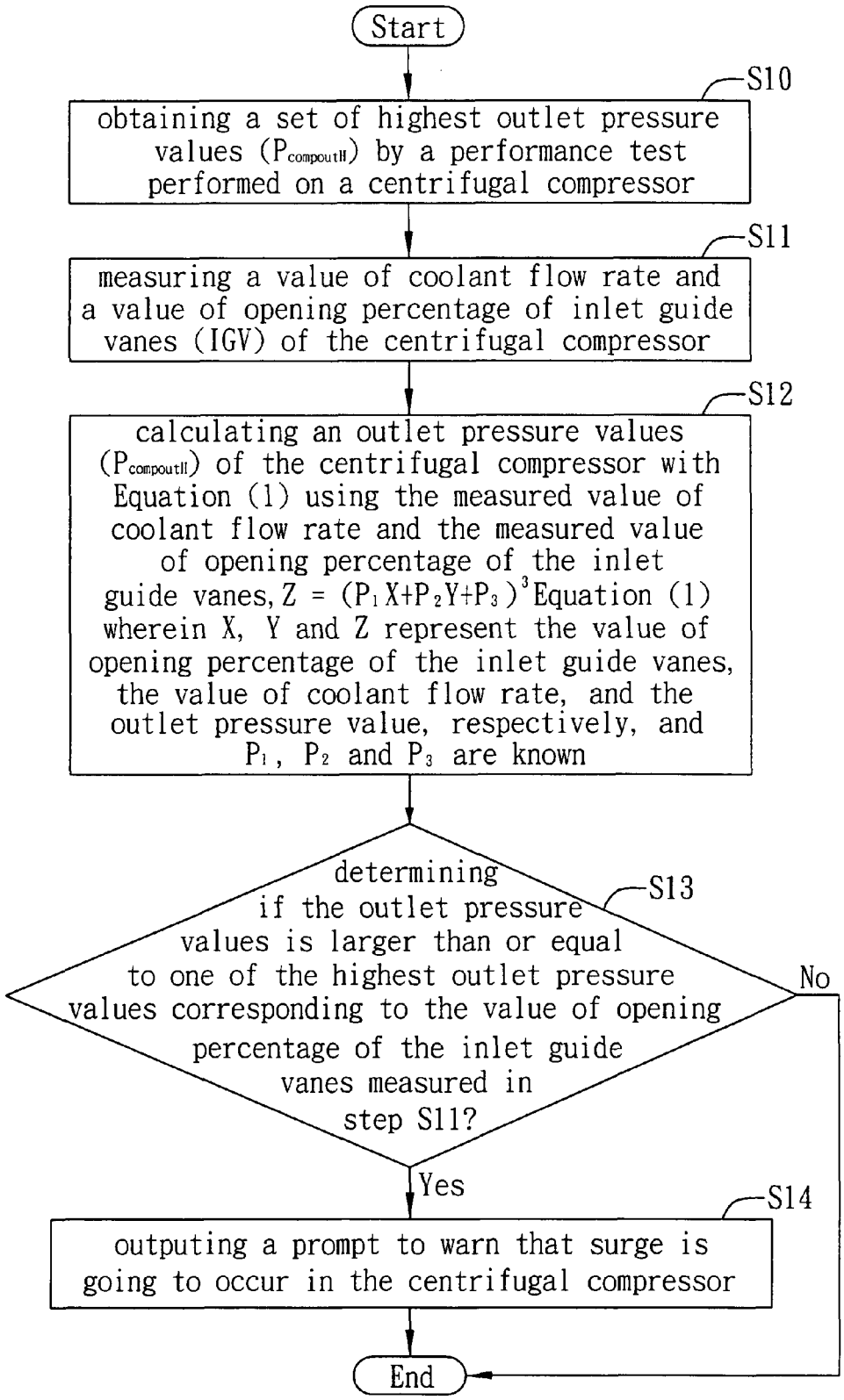
FIG. 1 is a flowchart of the method for predicting surge in a compressor in accordance with a preferred embodiment of the present invention.

FIG. 1 is a flowchart of a method for predicting surge in a compressor in accordance with the preferred embodiment of the present invention. The method is applicable to a cooling apparatus equipped with a centrifugal compressor. In this embodiment, the cooling apparatus is a chiller and is applicable to a central air conditioning system. The method begins with step S10 as shown in FIG. 1.

Figure 2A:
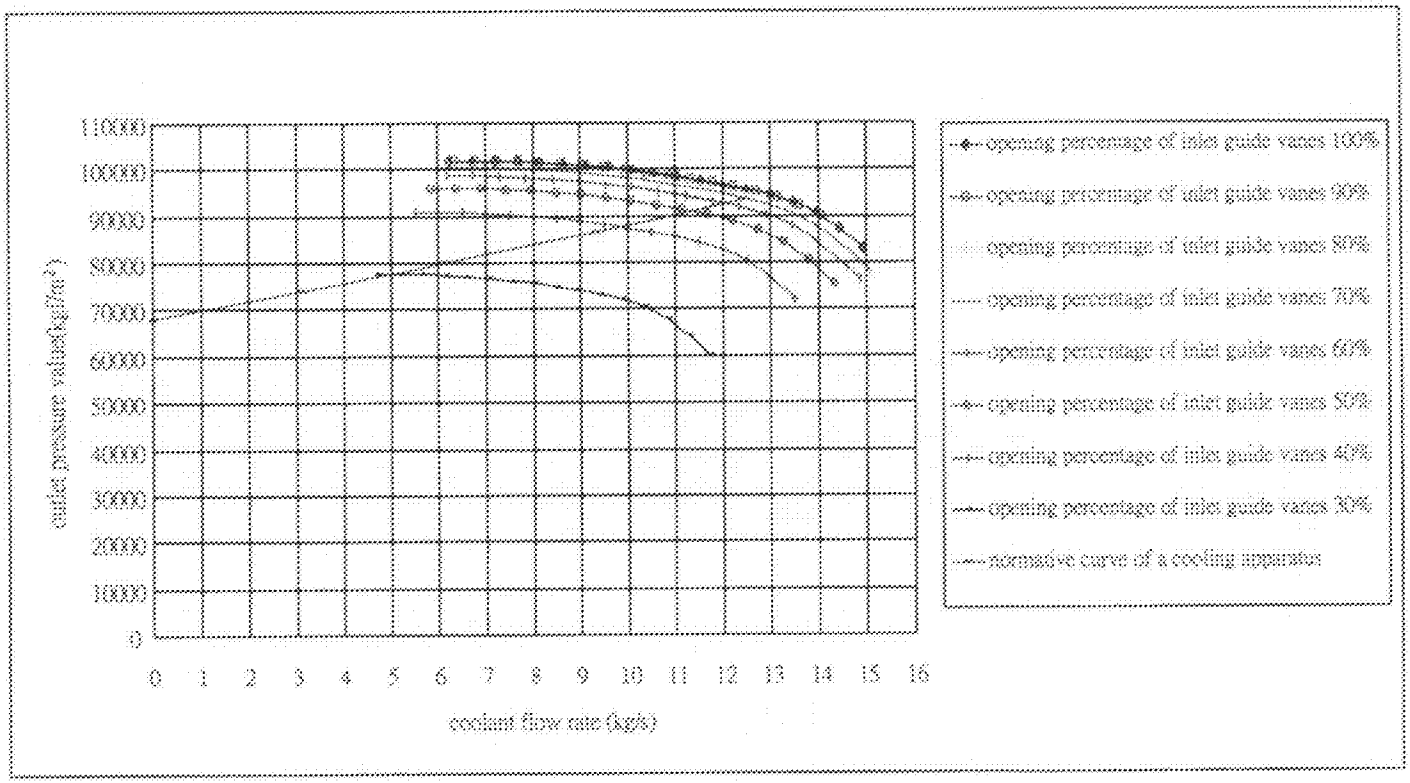
FIG. 2A is a graph plotting performance curves of the relationship between inlet guide vane opening percentages, coolant flow rates, and outlet pressure values of a centrifugal compressor in a cooling apparatus employing the method for predicting surge in a compressor in accordance with the present invention.

In step S10, a set of highest outlet pressure values ($P_{compoutH}$) is obtained by a performance test performed on the centrifugal compressor. In this embodiment, the performance tests for respective opening percentages of inlet guide vanes (IGV) of the centrifugal compressor are carried out to obtain performance curves of the relationship between opening percentages of the inlet guide vanes, coolant flow rates and outlet pressure values of the centrifugal compressor as shown in FIG. 2A, and the highest allowable outlet pressure values corresponding to the respective opening percentages of the inlet guide vanes can be identified from the performance curves. It should be understood that the number of performance curves is not limited to that shown in FIG. 2A.

FIGS. 2B to 2I are tables showing coolant flow rate values and outlet pressure values for the respective opening percentages of the inlet guide vanes in FIG. 2A. As shown in FIGS. 2B to 2I, the highest outlet pressure values are 77640 (kgf/m$^2$) for the inlet guide vane opening percentage of 30% (0.3), 90840 (kgf/m$^2$) for the inlet guide vane opening percentage of 40% (0.4), 95920 (kgf/m$^2$) for the inlet guide vane opening percentage of 50% (0.5), 98660 (kgf/m$^2$) for the inlet guide vane opening percentage of 60% (0.6), 100300 (kgf/m$^2$) for the inlet guide vane opening percentage of 70% (0.7), 101200 (kgf/m$^2$) for the inlet guide vane opening percentage of 80% (0.8), 101900 (kgf/m$^2$) for the inlet guide vane opening percentage of 90% (0.9), and 101900 (kgf/m$^2$) for the inlet guide vane opening percentage of 100% (1). It should be noted that the tables shown in FIGS. 2B to 2I merely show the parameters related to the method of the present invention, but the values of other parameters can also be obtained by the performance test in practice. The method then proceeds to step S11.

In step S11, a value of coolant flow rate and a value of opening percentage of the inlet guide vanes of the centrifugal compressor are measured. In this embodiment, the measuring step S11 is carried out in a real-time manner or a periodic manner. For example, in the case of periodically measuring the coolant flow rate value and the opening percentage value of the inlet guide vanes of the centrifugal compressor, the two values are measured during a definite period of time, such as one minute, and then the average coolant flow rate and the average opening percentage of the inlet guide vanes are calculated by taking the moving averages. The method of the present invention is not limited to this exemplified way of detection and calculation. Then, the method proceeds to step S12.

In step S12, an outlet pressure value ($P_{compout}$) of the centrifugal compressor is calculated with Equation (1) using the detected coolant flow rate value and the detected opening percentage value of the inlet guide vanes, $$Z=(P_1X+P_2Y+P_3)^3 \qquad \text{Equation (1)}$$

wherein X, Y and Z represent the opening percentage value of the inlet guide vanes, the coolant flow rate value, and the outlet pressure value, respectively, and $P_1$, $P_2$ and $P_3$ are known values of coefficients. In this embodiment, the values of coefficients in Equation (1) are calculated by Equation (1) using a plurality of sets of the opening percentage values of the inlet guide vanes, the coolant flow rate values and the outlet pressure values (as shown in FIGS. 2B to 2I) read from the performance curves (as shown in FIG. 2A) obtained by the performance test performed on the centrifugal compressor.

Figure 3:
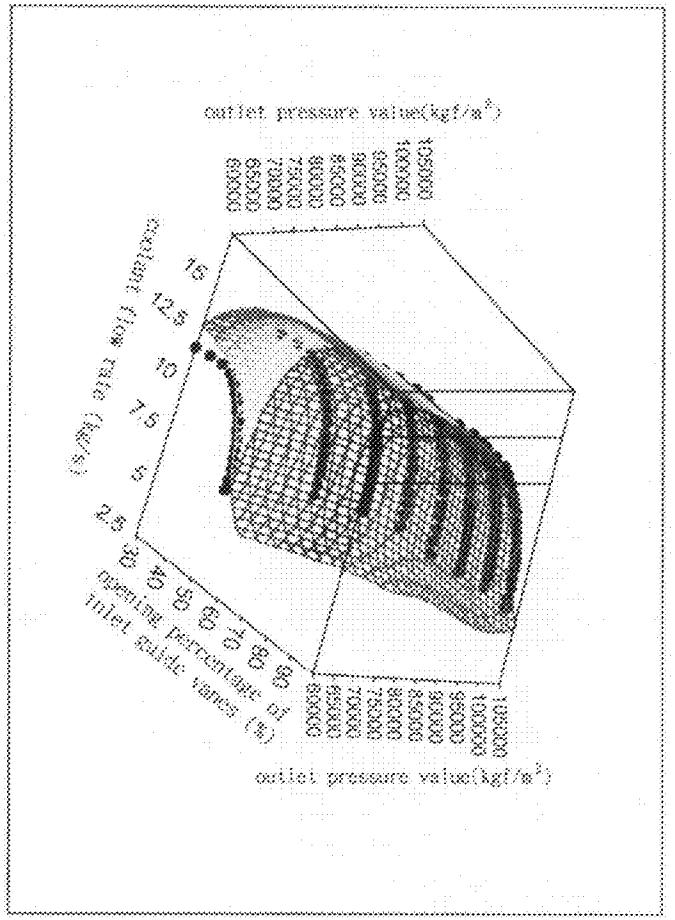
FIG. 3 is a three-dimensional graph plotting a simulation of the relationship between inlet guide vane opening percentages, coolant flow rates, and outlet pressure values of FIG. 2A.

FIG. 3 is a three-dimensional graph plotting a simulation of the relationship between the inlet guide vane opening percentages, the coolant flow rates, and the outlet pressure values of FIG. 2A, wherein black dots clearly indicate the plurality of sets of the opening percentage values of the inlet guide vanes, the coolant flow rate values and the outlet pressure values of the centrifugal compressor for calculation with Equation (1). It should be noted that the number of the black dots is not limited to that shown in FIG. 3. The precision of the values of coefficients calculated by Equation (1) depends on the number of the sets of inlet guide vane opening percentage values, coolant flow rate values and outlet pressure values used in the calculation. In other words, the more sets of the inlet guide vane opening percentage values, coolant flow rate values and outlet pressure values are acquired, the more precise the values of coefficients calculated by Equation (1) are.

A process of calculating the values of coefficients is exemplified as follows.

Equation (1) (i.e. $Z=(P_1X+P_2Y+P_3)^3$) is expanded to read: $Z=P_1^3X^3+P_2^3Y^3+3P_1^2P_2X^2Y+3P_1P_2^2XY^2+3P_1^2P_3X^2+3P_2^2P_3Y^2+6P_1P_2P_3XY+3P_1P_3^2X+3P_2P_3^2Y+P_3^3$, including a total of ten terms. The plurality of sets of inlet guide vane opening percentage values, coolant flow rate values, and outlet pressure values read from the performance curves obtained by the performance test performed on the centrifugal compressor of the cooling apparatus as shown in FIG. 2A are substituted into Equation (1). The ten terms are solved by simultaneous equations to read: $P_3^3=21836.952$, $3P_1P_3^2=3833.9265$, $3P_2P_3^2=-7752.849$, $3P_1^2P_3=-50.260129$, $3P_2^2P_3=880.58716$, $6P_1P_2P_3=22.58319$, $P_1^3=0.23413617$, $P_2^3=-49.355134$, $3P_1P_2^2=3.7448195$, $3P_1^2P_2=-0.57460569$. Subsequent calculation yields $P_1=0.616344$, $P_2=-3.66812$, and $P_3=27.951$.

Thereby, Equation (1) becomes $Z=[0.616344X+(-3.66812)Y+27.951]^3$. Given that X and Y (i.e. the detected opening percentage value of the inlet guide vanes and the detected coolant flow rate value of the centrifugal compressor in step S11) are known, Z (i.e. the outlet pressure value ($P_{compout}$) of the centrifugal compressor) can be figured out by Equation (1).

Further in step S12 of this embodiment, the outlet pressure value calculated by Equation (1) is multiplied by a corrective coefficient ranging between 90% and 100% (i.e. 90%≦corrective coefficient<100%).

In step S13, it determines if the outlet pressure value is larger than or equal to one of the highest outlet pressure values corresponding to the opening percentage value of the inlet guide vanes detected in step S11. In this embodiment, the outlet pressure value calculated in step S12 (figured out by Equation (1) using the measured opening percentage value of the inlet guide vanes and the detected coolant flow rate value) is compared with the highest corresponding outlet pressure value (obtained by the performance test performed on the centrifugal compressor), and if the outlet pressure value is larger than or equal to the highest corresponding outlet pressure value, it indicates that surge is going to occur in the centrifugal compressor. For example, if the opening percentage of the inlet guide vanes measured in step S11 is 30%, the highest corresponding outlet pressure value can be identified (in this embodiment, the highest outlet pressure value corresponding to the 30% opening percentage is 77640 (kgf/m$^2$)). The outlet pressure value is then compared with the corresponding highest outlet pressure value (77640 (kgf/m$^2$)) to determine if the outlet pressure value is larger than or equal to 77640. If yes, it will confirm imminent surge in the centrifugal compressor. The method then proceeds to step S14.

In step S14, a prompt is outputted to warn that surge is going to occur in the centrifugal compressor. In this embodiment, if it confirms imminent surge in the centrifugal compressor from the result of step S13, a prompt can be outputted through screen display, lamp display or audible alert to warn an associated operator for the centrifugal compressor that surge is going to occur; thus providing the operator with a basis of preparation for surge elimination by methods such as closing the inlet guide vanes and opening a hot-gas bypass (HGBP).

Therefore, the method for predicting surge in a compressor according to the present invention comprises the steps of: obtaining a set of highest outlet pressure values by a performance test performed on the centrifugal compressor; measuring values of coolant flow rate and opening percentage of inlet guide vanes of the centrifugal compressor; calculating an outlet pressure value of the centrifugal compressor with an equation using the measured value of coolant flow rate and the measured value of opening percentage of the inlet guide vanes; and determining if the outlet pressure value is larger than or equal to one of the highest outlet pressure values corresponding to the measured inlet guide vane opening percentage value to confirm if there is imminent surge in the centrifugal compressor. Particularly, the above Equation (1) is used to calculate the outlet pressure value of the centrifugal compressor after the value of coolant flow rate and the value of opening percentage of the inlet guide vanes of the centrifugal compressor are measured; then, the outlet pressure value is compared with the highest corresponding outlet pressure value to determine if the outlet pressure value is larger than or equal to the highest corresponding outlet pressure value; and if yes, it indicates that surge is going to occur in the centrifugal compressor. Thus, this provides a basis of preparation for surge elimination. In comparison with the prior art, the compressor surge prediction method disclosed in the present invention can predict whether surge is going to occur in the centrifugal compressor without entailing any complicated logical determination procedure. The present invention therefore provides a simple method for predicting surge in a compressor.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded in the broadest interpretation so as to encompass all such modifications and similar arrangements.

What is claimed:

1. A method for predicting surge in a compressor, applicable to a cooling apparatus equipped with a centrifugal compressor, the method comprising the steps of:

(1) obtaining a set of highest outlet pressure values by a performance test performed on the centrifugal compressor;

(2) detecting a value of coolant flow rate and a value of opening degree of inlet guide vanes of the centrifugal compressor;

(3) calculating an outlet pressure value of the centrifugal compressor with an equation below using the detected value of coolant flow rate and the detected value of opening degree of the inlet guide vanes, and multiplying the outlet pressure value by a corrective coefficient, $$Z=(P_1X+P_2Y+P_3)^3$$

wherein X, Y and Z represent the value of opening degree of the inlet guide vanes, the value of coolant flow rate, and the outlet pressure value, respectively, and $P_1$, $P_2$ and $P_3$ are known values of coefficients; and (4) determining if the outlet pressure value that is multiplied by the corrective coefficient is larger than or equal to one of the highest outlet pressure values corresponding to the value of opening degree of the inlet guide vanes detected in step (2), and confirming imminent surge in the centrifugal compressor if the outlet pressure value is larger than or equal to the corresponding one of the highest outlet pressure values, so as to provide a basis of preparation for surge elimination, and outputting a prompt to warn that surge is going to occur in the centrifugal compressor upon determination that the outlet pressure value is larger than or equal to the corresponding one of the highest outlet pressure values.

2. The method of claim 1, wherein the cooling apparatus is a chiller.

3. The method of claim 1, wherein the detection in step (2) is performed in one of a real-time manner and a periodic manner.

4. The method of claim 1, wherein the coefficients in the equation are calculated by the equation using a plurality of sets of values of opening degree of the inlet guide vanes, values of coolant flow rate and outlet pressure values read from performance curves obtained by the performance test performed on the centrifugal compressor of the cooling apparatus.

5. The method of claim 1, wherein the corrective coefficient ranges from at least 90% to smaller than 100%.

6. The method of claim 1, wherein the prompt is outputted by means of one of screen display, lamp display, and audible alert.

* * * * *